US006374409B1

(12) United States Patent
Galy

(10) Patent No.: US 6,374,409 B1
(45) Date of Patent: Apr. 23, 2002

(54) ACCESSORY PROVIDING PROTECTION AGAINST FALLS IN SPORTS SUCH AS IN-LINE SKATING

(75) Inventor: Philippe Galy, Pugny-Chatenod (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/744,249

(22) PCT Filed: May 31, 2000

(86) PCT No.: PCT/FR00/01499

§ 371 Date: Jan. 31, 2001

§ 102(e) Date: Jan. 31, 2001

(87) PCT Pub. No.: WO00/74510

PCT Pub. Date: Dec. 14, 2000

(30) Foreign Application Priority Data

Jun. 8, 1999 (FR) ..... 99 07468

(51) Int. Cl.[7] ..... A41D 13/00
(52) U.S. Cl. ..... 2/24
(58) Field of Search ..... 2/24, 16, 20, 59, 2/455; 128/878, 879, 881–882, 892; 602/20–23, 26, 62–63

(56) References Cited

U.S. PATENT DOCUMENTS 3,463,147 A * 8/1969 Stubbs ..... 128/80
5,711,029 A 1/1998 Visco et al.
5,727,252 A 3/1998 Oetting et al.
5,915,529 A 6/1999 Popowski
D434,878 S 12/2000 Bonaventure et al.
D436,696 S 1/2001 Bonaventure et al.
6,219,843 B1 4/2001 Passi et al.

FOREIGN PATENT DOCUMENTS

EP 0876770 11/1998

* cited by examiner

*Primary Examiner*—Gloria M. Hale
*Assistant Examiner*—Tejash Patel
(74) *Attorney, Agent, or Firm*—Greenblum & Bernstein P.L.C.

(57) ABSTRACT

An accessory for protection against falls during the practice of a sport, adapted to cover two projecting parts of a limb extending from a bending zone in angularly distinct planes, especially elbow, knees, and including at least the following parts: a flexible element surrounding, at least partially, each of the two parts of the limb; a protective element formed of a rigid or semi-rigid material associated locally with the flexible element; the protective element being connected to the flexible element; and at least one tightening element for the assembly thus formed adapted to maintain it in place around the limb, wherein the tightening element is a strap surrounding one of the two parts of the limb, outside the bending zone on the latter, by being superimposed on the flexible element, whether or not via the protective element.

17 Claims, 2 Drawing Sheets

ACCESSORY PROVIDING PROTECTION AGAINST FALLS IN SPORTS SUCH AS IN-LINE SKATING

BACKGROUND OF THE INVENTION

1. Field of the Invention

The present invention relates to an accessory for protection against falls adapted more particularly to the practice of sports, and more specifically to roller skating, in-line roller skating, or skateboarding.

2. Description of Background and Relevant Information

In skating, in particular, it is important to have great freedom of movement to be able to move efficiently, perform figures or jumps, or execute braking or accelerating movements. The risk involved in practicing the sport comes from the fact that if the skater loses his balance, he can fall on hard and non-cushioned surfaces that can cause serious injuries.

That is the reason why protective accessories have been designed, which aim at limiting the risks of injuries, especially in the most vulnerable areas, i.e., the head, hands, knees, and elbows.

Criticism often targeting these protective accessories relates either to their inadequate protection, due to their generally approximate design, or their bulkiness that is too substantial which has the effect of limiting limb mobility, generating too much heat, and affecting the fluidity of movements, as well as the artistic or aesthetic appearance during skating.

In terms of protection, the proposed systems do not adequately take into account that the parts to be protected in the same area, generally projecting parts, can be multiple and oriented in planes that are distinct from one another. Thus, most often, either protection is efficient only in a particular plane but inefficient or inadequate in another plane, or protection is efficient in all of the planes but at the cost of bulkiness that is too substantial.

The proposed systems are also generally complicated and time-consuming to fit, which renders them unattractive for use in all occasions, especially for uses over a short period of time or without apparent difficulties. However, it is often under these circumstances that accidents occur.

Therefore, there is a need to improve the current systems to better adapt these systems to the morphology of the body parts to be protected, reducing bulkiness to facilitate mobility, and facilitating the positioning of these systems so as to render their use unavoidable.

With respect to protecting the elbows, in particular, there are two kinds of elbow pads, those that are slipped on and those that are attached. Those that are slipped on are particularly advantageous because they become as one with the elbow. However, because the fastening is not positive, there is a risk of losing them during the practice of the sport. With respect to those that are attached, they are often equipped with a buckle tightening system. However, if their fastening is more efficient, they are not as comfortable as those that are slipped on.

The aforementioned fastening systems are generally constituted of straps that are fixed in the area of the bend of the elbow, or from two straps that intersect at the same bend of the elbow.

The result is a discomfort for the user and, in addition, since this part is active, it causes these straps to loosen very quickly.

SUMMARY OF THE INVENTION

An object of the present invention is to overcome the aforementioned various disadvantages and, to this end, the invention relates to an accessory for protection against falls during the practice of a sport, which is adapted to cover two projecting parts of a limb extending from a bending zone in angularly distinct planes, especially elbow, knees, and including:

- a flexible element surrounding at least partially each of the two parts of the limb;
- a protective element formed of a rigid or semi-rigid material associated locally with the flexible element;
- means for connecting the protective element on the flexible element;
- a least one tightening element of the assembly thus formed, adapted to maintain it in place around said limb;
  - wherein the tightening element is a strap surrounding one of the two parts of the limb, outside the bending zone of the latter, by being superimposed on the flexible element, whether or not via the protective element.

According to the invention, it is to be readily understood that the strap, by being independent of the bend of the limb in surrounding one of the parts of the limb that is rigid, enables a positive fastening of the protective accessory, in particular for protecting an elbow.

The present invention also relates to the characteristics that will become apparent from the description that follows, and which must be considered separately or according to all their possible technical combinations.

BRIEF DESCRIPTION OF DRAWINGS

The description, provided by way of a non-limiting example, will be better understand with regard to how the invention can be embodied, with reference to the annexed drawings, in which.

DETAILED DESCRIPTION OF THE INVENTION

Figure 1:
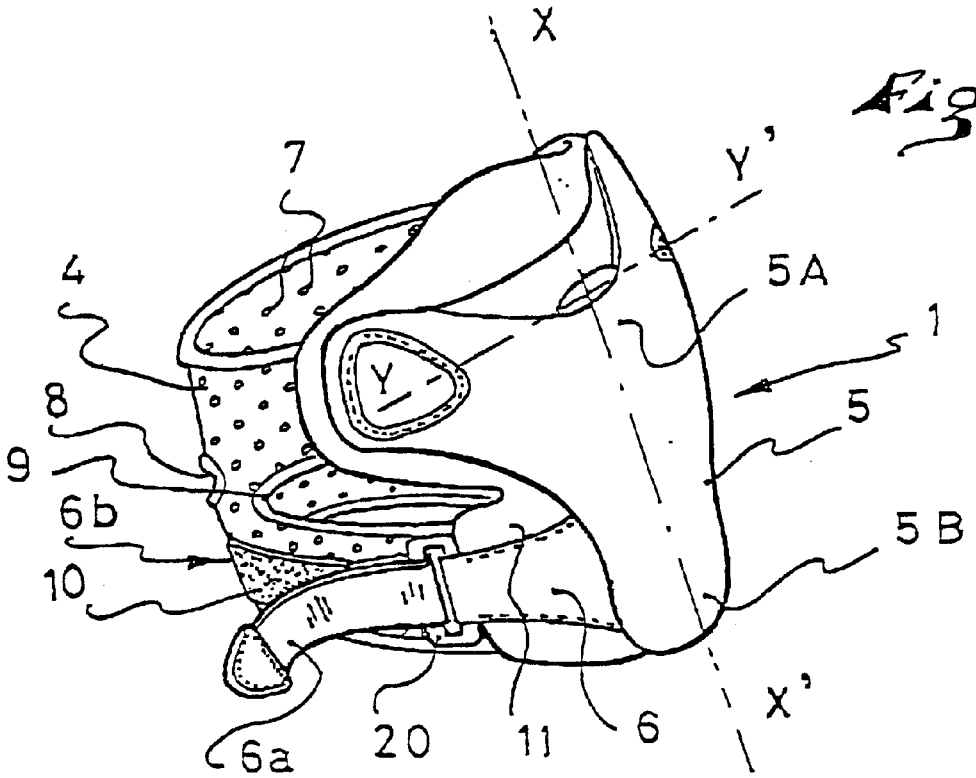
FIG. 1 shows a perspective view of a protective accessory according to the invention, adapted more particularly to protect an elbow.
Figure 2:
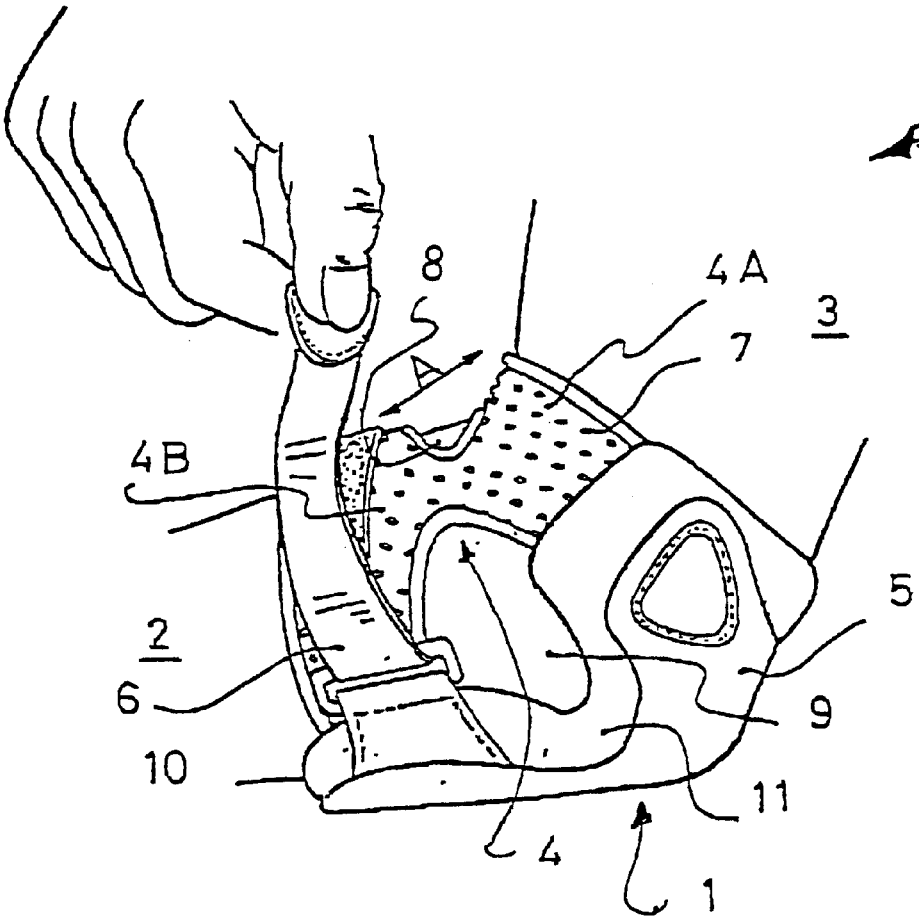
FIG. 2 is a side view of the elbow pad according to FIG. 1, during positioning on a user's arm.
Figure 3:
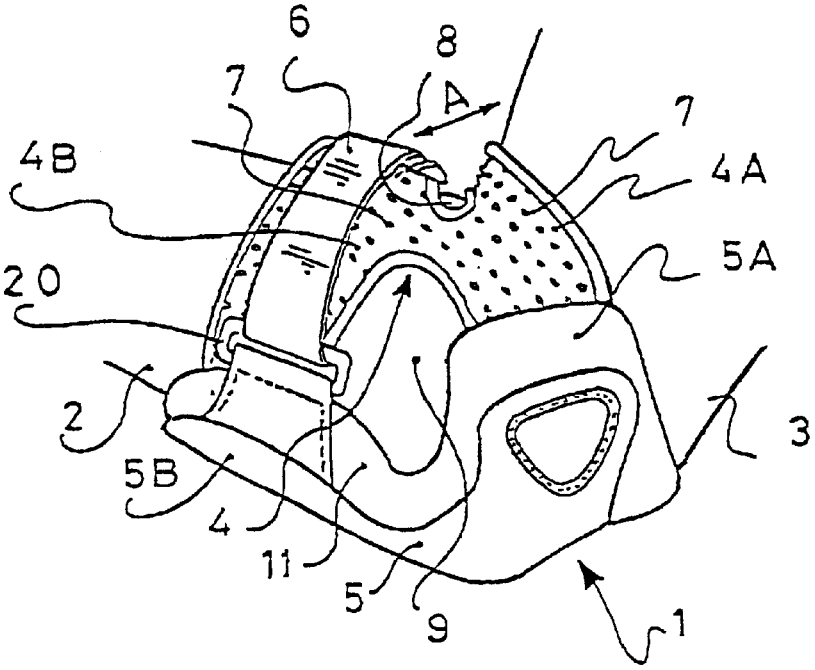
FIG. 3 is a side view of the elbow pad according to FIGS. 1 and 2, after being positioned on a user's arm, for a folded position of the arm.
Figure 4:
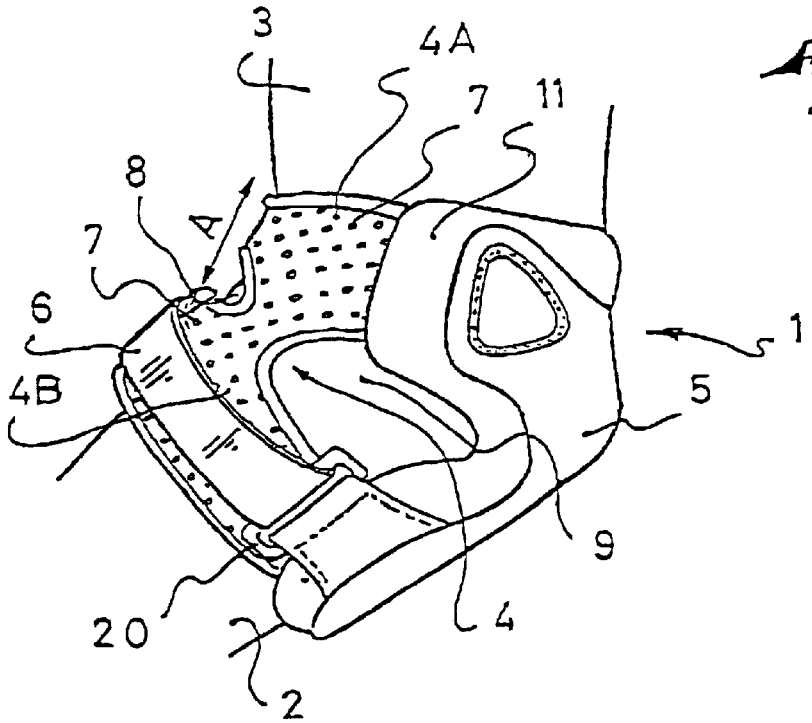
FIG. 4 is a side view of the elbow pad according to FIGS. 1 and 2, after being positioned on a user's arm, for an unfolded position of the arm.

The protective accessory, generally designated by the reference numeral 1 in the figures, is adapted to protect a user against falls during the practice of a sport.

Generally speaking, it is adapted to cover two projecting parts 2 and 3 of a limb extending from a bending zone A in angularly distinct planes.

According to the illustrated embodiment of the invention, the protective accessory 1 is an elbow pad including:

a flexible element 4 surrounding, at least partially, each of the two parts 2, 3 of the limb;

a protective element 5 formed of a rigid or semi-rigid material associated locally with the flexible element;

means for connecting the protective element 5 on the flexible element 4; at least one tightening element 6 of the assembly thus formed, adapted to maintain it in place around said limb 2, 3.

Generally speaking, the tightening element 6, according to the invention, is a strap surrounding one and/or the other of the two parts 2, 3 of the limb, outside their bending zone A, by being superimposed on the flexible element 4, whether or not via the protective element 5.

More specifically, with respect to an elbow pad, the tightening strap 6 is arranged on a zone of the flexible element 4 covering one of the parts of the limb that is directed toward the end thereof, in this case the forearm 2.

According to another characteristic of the invention, the flexible element 4 is constituted by an elastically deformable tubular band which goes around the arm 3 and the forearm 2 in the bending zone A via the rigid or semi-rigid element 5 for protecting the elbow.

The tubular band constituting the flexible element 4 has elastic and dimensional properties so as to induce an elastic pressure which is both relatively low to enable it to be slipped into position, therefore using only one hand, while ensuring maximum comfort, and sufficiently high to ensure its correct positioning with respect to the elbow before adjusting the tightening strap 6 on the forearm 2.

Preferably, the tubular band constituting the flexible element 4 is made out of a perforated elastic material, such that the perforations 7 ensure the ventilation and the evacuation of perspiration from the zone of the member 2, 3 which it surrounds.

According to the illustrated example of the invention shown in the drawing, the tubular band constituting the flexible element 4 is divided into two portions 4A, 4B. Portion 4A surrounds the arm 3 and the other portion 4B surrounds the forearm 2 on both sides of the elbow, both being separated by a median notch 8 obtained in the bending zone A of the elbow, on the one hand, and by two lateral notches 9 located on both sides of said elbow, on the other hand, such that the elbow pad 1 is provided with a maximum degree of freedom in folding or unfolding during the practice of a sport.

According to another characteristic of the invention, the rigid or semi-rigid protective element 5 is constituted by a shell that is incurved about two axes XX' and YY' perpendicular to one another so as to form, in the area of the elbow, a generally T-shaped channel whose horizontal arm 5A directed rearwardly extends on both sides of said elbow, and whose vertical arm 5B extends forwardly beneath the forearm 2 by forming a median bending angle, the lateral edges of said vertical arm being provided with elements for fastening the tightening strap 6.

Furthermore, the tightening strap 6 comprises, at one free end 6*a*, closure mechanism or means 10 adapted to removably cooperate with a complementary mechanism or means after passage into a traction buckle 20 arranged at an opposite fixed end 6*b* of the same strap 6, after surrounding the flexible element 4 in the zone of the forearm 2.

Preferably, the means 10 for closing the strap 6 on itself are constituted by self-gripping elements arranged on the free end 6*a* of the strap 6 and on another one of its corresponding portions 6*b* which is opposite during the closure.

These closure mechanisms or means could be different and could consist of systems that include a buckle, buttons, laces, etc.

The elbow pad 1 is constituted by successively attaching on the inner surface of the rigid or semi-rigid protective element 5:

the tightening strap 6 in its front zone corresponding to that of the forearm 2;

a padding material 11 adapted to ensure comfort and shock absorption; the tubular band 4 constituting the flexible element.

Thus, the padding 11 can be made of foam or gel, according to a predetermined thickness.

With respect to the protective element 5 itself, it can be made of plastic or leather. The latter can be provided to be removable, so that it can be replaced, when it is worn out, and/or washed.

What is claimed is:

1. An accessory for protection against falls during the practice of a sport, adapted to cover two projecting parts of a limb extending from a bending zone in angularly distinct planes, said accessory comprising:

an assembly comprising:

a flexible element having a structure to extend around each of the two projecting parts of the limb;

a protective element formed of a rigid or semi-rigid material associated locally with the flexible element, the protective element being connected to the flexible element to provide a structure to surround each of the two projecting parts of the limb; and at least one tightening element of the assembly, said tightening element being adapted to maintain the assembly in place around said limb, the tightening element comprising a strap to surround one of the two projecting parts of the limb, outside the bending zone of the limb, by being superimposed on the flexible element, whether or not via the protective element.

2. An accessory according to claim 1, wherein the limb is an arm and the accessory is adapted to protect an elbow of the arm, and wherein:

the tightening strap is positionable on an area of the flexible element covering a forearm of the arm.

3. An accessory according to claim 2, wherein:

the flexible element is constituted by an elastically deformable tubular band to extend around the forearm and an upper arm of the arm in the bending zone via the rigid or semi-rigid element for protecting the elbow, the flexible element having elastic and dimensional properties so as to induce an elastic pressure, said elastic pressure being relatively low to enable the flexible element to be slipped into position using only a single hand and ensuring maximum comfort, said elastic pressure being relatively high to enable the flexible element to be correctly positioned with respect to the elbow before positioning the tightening strap on the forearm.

4. An accessory according to claim 3, wherein:

the tubular band constituting the flexible element comprises a perforated elastic material having perforations to ensure ventilation and evacuation of perspiration from the arm.

5. An accessory according to claim 3, wherein:

the tubular band constituting the flexible element is divided into two portions, a first of the two portions to surround the upper arm and a second of the two portions to surround the forearm on opposite sides of the elbow, both of the two portions being separated by a median notch in the bending zone of the elbow and by two lateral notches on opposed sides of the elbow, such that the accessory is provided with a maximum degree of freedom in folding or unfolding during the practice of a sport.

6. An accessory according to claim 1, wherein the limb is an arm and the accessory is adapted to protect an elbow of the arm, and wherein:

the rigid or semi-rigid protective element is constituted by a shell that is incurved about two axes perpendicular to one another so as to form, in an area of the elbow, a generally T-shaped channel having a rearwardly directed horizontal arm extending on opposed sides of the elbow and a forwardly directed vertical arm beneath the forearm by forming a median bending angle, the lateral sides of the vertical arm of the T-shaped channel being provided with elements for fastening the tightening strap.

7. An accessory according to claim 1, wherein the limb is an arm and the accessory is adapted to protect an elbow of the arm, and wherein:

on an inner surface of the rigid protective element the following are successively attached:

the tightening strap in a front zone corresponding to an area of a forearm of the arm;

a padding material to ensure comfort and shock absorption;

the tubular band constituting the flexible element.

8. An accessory according to claim 1, wherein the limb is an arm and the accessory is adapted to protect an elbow of the arm, and wherein:

the tightening strap comprises a free end;

at the free end, means are provided for closing the tightening strap on itself, said means being adapted to removably cooperate with a complementary means after passage into a traction buckle arranged at an opposite fixed end of the tightening strap, after surrounding the flexible element in a zone of a forearm of the arm.

9. An accessory according to claim 8, wherein:

the means for closing the tightening strap on itself are constituted by first self-gripping elements arranged on the free end of the tightening strap and second self-gripping elements arranged on a corresponding portion positioned opposite the first self-gripping elements during closure of the tightening strap.

10. An accessory according to claim 1, wherein:

said at least one tightening element consists of a single tightening element for the accessory.

11. An accessory for protection against falls during the practice of a sport, adapted to cover two projecting parts of an arm or leg extending from an elbow or knee in angularly distinct planes, said accessory comprising:

an assembly comprising:

a protective element formed of a rigid or semi-rigid material adapted to be positioned over the elbow or knee;

a flexible elastic element having respective portions connected to extend around each of the two projecting parts of the limb;

each of said respective portions of said flexible elastic element being permanently connected to respective portions of said protective element so that the assembly of said protective and flexible elastic elements encircle the arm or leg; and at least one tightening element to maintain said assembly in place around said arm or leg, said tightening element comprising a strap to extend around one of the two parts of the arm or leg, said strap being superimposed on said flexible elastic element.

12. An accessory according to claim 11, wherein:

said tightening element is the only tightening element for the accessory.

13. An accessory according to claim 12, wherein:

the accessory is adapted to cover a forearm and an upper arm, and said tightening element is to extend around the forearm.

14. An accessory for protection against falls during the practice of a sport, adapted to cover an upper projecting part and a lower projecting part of a limb, the upper and lower projecting parts extending from a bending zone in angularly distinct planes, said accessory comprising:

a flexible element surrounding, at least partially, the upper projecting part and the lower projecting part of the limb;

a protective element formed of a rigid or semi-rigid material associated locally with the flexible element;

means for connecting the protective element on the flexible element;

at least one tightening element of the assembly thus formed adapted to maintain the assembly in place around the limb;

wherein the rigid or semi-rigid protective element is constituted by a shell that is incurved about two substantially perpendicular axes to form a generally T-shaped channel, said T-shaped channel having a rearwardly positioned horizontal arm extending on opposite sides of the upper projecting part of the limb and a forwardly positioned vertical arm beneath the lower projecting part of the limb by forming a median bending angle.

15. An accessory according to claim 14, wherein:

said vertical arm of the T-shaped channel comprises a portion proximate said horizontal arm and a distal portion, said proximate portion of said T-shaped channel being narrower than said distal portion, and said distal portion of said T-shaped channel being significantly narrower than a length of said horizontal arm.

16. An accessory according to claim 14, wherein:

said protective element is adapted to cover upper and lower parts of a leg extending from a knee, said protective element being positioned over opposite extremities of said flexible element.

17. An accessory according to claim 14, wherein:

said protective element is adapted to cover upper and lower parts of an arm extending from an elbow, said protective element being positioned over opposite extremities of said flexible element.

* * * * *